US009197976B2

(12) United States Patent
Park et al.

(10) Patent No.: US 9,197,976 B2
(45) Date of Patent: Nov. 24, 2015

(54) SECURITY SYSTEM BASED ON SOUND FIELD VARIATION PATTERN ANALYSIS AND THE METHOD

(75) Inventors: Kang-Ho Park, Daejeon (KR); Sung Q Lee, Daejeon (KR)

(73) Assignee: ELECTRONICS AND TELECOMMUNICATIONS RESEARCH INSTITUTE, Seoul (KR)

( * ) Notice: Subject to any disclaimer, the term of this patent is extended or adjusted under 35 U.S.C. 154(b) by 560 days.

(21) Appl. No.: 13/601,883

(22) Filed: Aug. 31, 2012

(65) Prior Publication Data

US 2013/0162821 A1 Jun. 27, 2013

(30) Foreign Application Priority Data

Dec. 26, 2011 (KR) ..... 10-2011-0142499

(51) Int. Cl.

| | |
|---|---|
| ***G08B 13/00*** | (2006.01) |
| ***H04R 29/00*** | (2006.01) |
| ***G08B 13/16*** | (2006.01) |
| ***G08B 13/196*** | (2006.01) |

(52) U.S. Cl.

CPC ..... *H04R 29/007* (2013.01); *G08B 13/1609* (2013.01); *G08B 13/1672* (2013.01); *G08B 13/19695* (2013.01); *G08B 13/19697* (2013.01)

(58) Field of Classification Search

CPC ..... G08B 13/19697; G08B 13/19695; G08B 3/1609; G08B 13/1672; G08B 13/00; H04R 29/007

USPC ..... 340/541, 540, 545.2, 565, 551, 552, 340/544, 691.1, 692, 693.5; 367/93, 187

See application file for complete search history.

(56) References Cited

U.S. PATENT DOCUMENTS

| | | | | |
|---|---|---|---|---|
| 5,696,489 | A * | 12/1997 | Haynes et al. | 340/541 |
| 5,828,626 | A | 10/1998 | Castile et al. | |
| 6,587,047 | B2 * | 7/2003 | Nilsson et al. | 340/554 |
| 7,535,351 | B2 | 5/2009 | Reymond | |
| 2008/0224863 | A1 * | 9/2008 | Bachmann | 340/541 |
| 2010/0128123 | A1 * | 5/2010 | DiPoala | 348/143 |

FOREIGN PATENT DOCUMENTS

| | | | |
|---|---|---|---|
| JP | 2011-080868 | A | 4/2011 |
| KR | 10-2003-0005105 | A | 1/2003 |
| KR | 10-2011-0026753 | A | 3/2011 |
| KR | 10-2011-0067243 | A | 6/2011 |

* cited by examiner

*Primary Examiner* — Anh V La

(57) ABSTRACT

The present disclosure relates to security system and method based on sound field variation pattern. The present disclosure identifies a slow variation pattern of a acoustic transfer function occurring due to a gradual change in temperature and humidity of air according to a change in time and a change in a characteristic of an acoustic element, from a sudden sound field variation pattern within an internal space occurring due to an intrusion from an outside, activation of an air conditioning and heating device, and the like, or within a surveillance space induced by a change in an acoustic physical property. The present disclosure identifies sound field variation patterns occurring due to a change in an acoustic structure by an intrusion and a change in temperature and convection by air conditioning and heating. The present disclosure stores and verifies image information using an image obtaining apparatus.

11 Claims, 8 Drawing Sheets

SECURITY SYSTEM BASED ON SOUND FIELD VARIATION PATTERN ANALYSIS AND THE METHOD

CROSS-REFERENCE TO RELATED APPLICATIONS

This application is based on and claims priority from Korean Patent Application No. 2011-0142499, filed on Dec. 26, 2011, with the Korean Intellectual Property Office, the disclosure of which is incorporated herein in its entirety by reference.

TECHNICAL FIELD

The present disclosure relates to a security system and method based on sound field variation pattern analysis, and more particularly, to a security system and method based on sound field variation pattern analysis that detects and processes a sound field variation using an acoustic module such as a sound source generating apparatus, an acoustic receiving apparatus, and the like, a module processing an acoustic signal, and the like, and in this instance, detects a sound field variation pattern according to a change in time or a wavelength of a sound source and thereby increases the reliability of security detection

BACKGROUND

A security/surveillance system is field that has been studied for a long period of time and security surveillance technology includes a security camera scheme, an infrared (IR) scheme, an ultrasound scheme, an acoustic measuring scheme, and the like.

Korean Patent Publication Application Laid-Open No. 2003-0005105 (Security Apparatus and Control Method Thereof) discloses a method that may monitor a surveillance space and provide countermeasures while a user is out through a detection means using a general IR sensor, an internal photographing camera, a speaker that generates an alert sound, and a high performance microphone for recording detected sound. That is, the above disclosure relates to an apparatus that may install a security system in a predetermined surveillance space to be monitored, and thereby detect an intrusion using an IR sensor and generate an alert sound, and may also transfer internal image and acoustic information to a security company, a police station, and a preset telephone to thereby monitor a security state, and a method of controlling the apparatus.

The above method may not detect an intrusion when an intruder is outside the intrusion detection range of an IR sensor, or when the intruder uses a method that enables the body temperature of the intruder not to be detected. The detectable range of the IR sensor is very narrow and thus, a large number of systems as above need to be installed for the thorough security. However, the malfunction of sensors occurring due to various external changes has become an issue.

As another related art, the U.S. Pat. No. 5,828,626 (Acoustic Object Detection System and Method, Otincon Corporation) discloses a method that emits an audible sound wave within a surveillance space, measures intensity of a normal wave acoustic signal and a phase change depending on whether an object is present, and thereby outputs an alert sound. However, instead of measuring a acoustic transfer function, the above method simply measures only intensity of an acoustic signal and thereby alerts an intrusion based on the difference. Therefore, a malfunction occurs due to a change in an acoustic signal by an environmental change and peripheral noise.

As still another related art, the U.S. Pat. No. 7,535,351 (Acoustic Intrusion Detection System) discloses a technology that generates an acoustic sound of an audio frequency domain using a dipole speaker (emitter), locates a pair of microphones (detectors) in dipole acoustic offset positions (null), and compares magnitude of a sound wave and a phase occurring due to an intruder with magnitude of a sound wave and a phase before intrusion to thereby detect the intrusion. However, the above method is limitedly used for a specified security area and malfunction usually occurs due to an environmental change or peripheral noise.

As yet another related art, Korean Patent Publication No. 2009-0123752 (Security System and Method Using Measurement of Sound field variation) discloses a security system and method that determines whether an intrusion has occurred in a predetermined space using a difference between an initially set sound and a sound by the intrusion. The above method erroneously recognizes, as the intrusion, a variation of a acoustic transfer function occurring due to a change in temperature of air and convection change, and a change in a temporal characteristic of a speaker, a microphone, and the like. Alternatively, since cameras for secondary verification are installed to be distributed and thereby used, it is inconvenient to install, move or remove the cameras.

A security camera scheme that is a conventional security/surveillance method needs to consecutively photograph a moving picture during security surveillance, and to store a large capacity of image information. Therefore, a price becomes expensive and power consumption becomes an issue in the case of a consecutive operation. To verify a security situation in real time, a human being needs to continuously monitor a camera image or to monitor a security situation such as intrusion through processing of smart image information. In this case, a very high cost is required and there are many constraints due to lack of concentration of a human being, inaccuracy of an intrusion recognizing algorithm, and the like. Even though an IR security module is inexpensive and uses a small amount of power, a non-operation/malfunctioning issue of security/surveillance is present when an intrusion occurs in such a manner that a subject wears IR blocking clothes or uses an IR blocking apparatus, and the intrusion detection range is narrow. An ultrasound security module has a power issue due to low efficiency of sound wave transfer to an air layer and also has a difficulty in applying a scan scheme due to high straightness. In most security monitoring modules, an area for detecting an intrusion or a security situation is significantly limited and narrow due to fundamental constraints thereof. In the case of ultrasound, the straightness is very excellent and thus, a surveillance area is very narrow. In the case of IR, there are some constraints on a distance and a range capable of detecting thermal change. A camera may not detect an intrusion situation occurring in a dead zone such as a side, rear, and the like deviated from a general angle of view of the camera. A technology of detecting a sound of an intruder has a difficulty in detecting an intruder who does not make a sound, and frequently malfunctions due to peripheral noise. As a technology of generating and measuring a sound, a conventional technology of measuring a sound field variation determines that even a simple sound field variation is an intrusion and thus, there may occur a malfunction to determine that even a sound field variation occurring due to an environmental change by a change in temperature of air and the like is an intrusion.

SUMMARY

The present disclosure has been made in an effort to provide an inexpensive, low power consuming, and highly reliable security surveillance system technology that prevents a non-functioning/malfunctioning issue found in a conventional security and surveillance system technology, increases reliability, and detects and processes an intrusion within a surveillance space and relevant information using an integral module by measuring a pattern of a variation of a acoustic transfer characteristic.

The present disclosure also provides an inexpensive, low power consuming, and highly reliable security surveillance system technology that minimizes a malfunctioning issue by detecting a variation pattern as well as a sound field variation and by outputting a highly accurate intrusion alert sound, and removes a dead zone by measuring a variation of a acoustic transfer characteristic.

The present disclosure also provides a portable security surveillance system that is configured to be complementary with existing security equipment and systems and thereby may increase reliability and accuracy of security surveillance, and may configure an image obtaining apparatus and the like as well as a sound source generating apparatus, an acoustic receiving apparatus, and a signal processing module to interact with each other in an integral type and thus, may be readily portable and installed or removed in a desired surveillance space such as a home, a vehicle, and the like as well as an office.

An exemplary embodiment of the present disclosure provides a security system based on sound field variation pattern analysis, including: a sound field variation detecting apparatus installed within a predetermined surveillance space to receive a sound wave that is received after generating a sound source, to measure a sound field variation pattern, and to detect an abnormal situation by reading the sound field variation pattern; and an operation apparatus to receive the sound field variation pattern and to notify an external apparatus about an emergency situation when the abnormal situation is detected. The sound field variation pattern may be obtained by measuring an intrusion determining signal value (signal-to-noise ratio (SNR)) that is a ratio of an initial acoustic transfer function deviation (noise) to a variation value of a acoustic transfer function for a predetermined time period.

Another exemplary embodiment of the present disclosure provides a security method based on sound field variation pattern analysis, including: outputting, by a sound field variation detecting apparatus installed within a predetermined surveillance space, a sound wave of an audio frequency band having a predetermined frequency band; receiving, by the sound field variation detecting apparatus, the sound wave to calculate a acoustic transfer function from the received sound wave; comparing, by the sound field variation detecting apparatus, the acoustic transfer function measured in an initial setting mode and the acoustic transfer function measured in a surveillance mode to determine whether an abnormal situation has occurred; analyzing, by the sound field variation detecting apparatus, the sound field variation pattern, to determine whether an intrusion has occurred, when the abnormal situation is determined to have occurred; and transferring, by the sound field variation detecting apparatus, the sound field variation pattern to an operation apparatus when the intrusion is determined to have occurred, and notifying, by the operation apparatus, a pre-registered external apparatus about whether the intrusion has occurred.

According to the exemplary embodiments of the present disclosure, it is possible to provide a low power consuming, inexpensive, and highly reliable security surveillance function that overcomes issues such as high power consumption, no-operation, a malfunction, a dead zone, and the like, found in a security camera, an IR scheme, an ultrasound scheme, an acoustic detection, and a sound field variation measuring scheme that are existing security/surveillance methods.

According to the exemplary embodiments of the present disclosure, by detecting a sound field variation pattern according to a change in time of a sound field variation or a frequency change of a sound source, instead of simply measuring a sound field variation, it is possible to identify a case in which a sound field variation occurs due to an environmental change such as a gradual or sudden change in temperature and humidity of air such as activation of an air conditioning and heating device from a case in which a sudden intrusion or accident occurs. Therefore, it is possible to increase the accuracy and reliability of security surveillance.

According to the exemplary embodiments of the present disclosure, a sound source generator, an acoustic receiver, a controller, an image obtaining unit, and the like, may be integrated into an integral type and thus, be readily carried, installed, moved, or removed within a desired surveillance space such as an office, home, a vehicle, and the like.

According to the exemplary embodiments of the present disclosure, in a situation where an intrusion, an accident, and the like is suspected to have occurred, it is possible to store an internal image and acoustic information about a surveillance space, and to transfer the stored internal image and acoustic information to a mobile phone user as well as a security office, a security company, and a police station to thereby determine and cope with the situation in real time.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
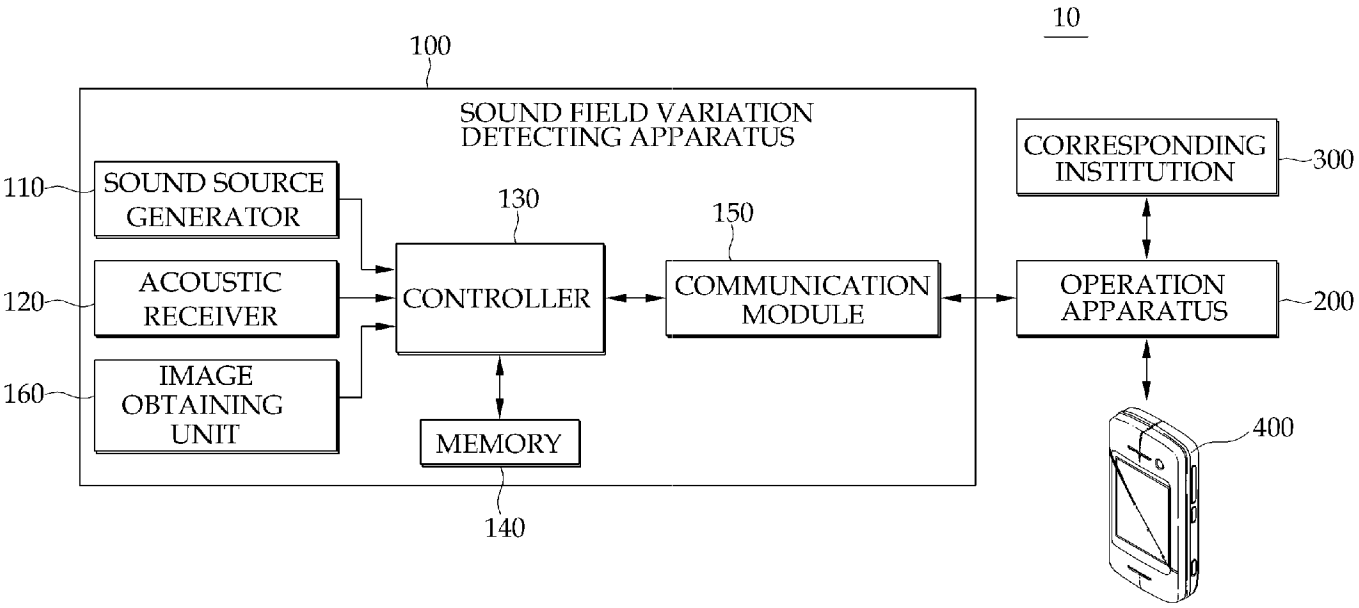
FIG. 1 is a block diagram illustrating a structure of a security system based on sound field variation pattern analysis according to an embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

The present disclosure provides a method that monitors whether an intrusion or an accident has occurred using a sound field variation occurring when a spatial structure varies or a sound physical property varies due to an intruding object or the occurrence of the accident within a surveillance space, and in this instance, identifies a temporally slowly varying pattern from a quickly varying pattern, detects a sound field variation pattern varying according to a frequency change of a sound source to thereby identify a change in the acoustic structure by an intrusion or an accident from a change by environmental factors such as a sudden change in temperature and humidity of air and a convection such as activation of an air conditioning and heating device, and thereby increases the accuracy and reliability of security surveillance.

Here, the present disclosure measures a acoustic transfer function that is determined as a ratio of a sound pressure value detected by an installed acoustic receiving apparatus by propagating, to the inside of a surveillance space, an acoustic sound that is generated by a sound source generating apparatus and has a predetermined sound pressure at predetermined time intervals. The measured acoustic transfer function is compared with an initial value in a security setting, and the corresponding difference is compared with a deviation of an initial acoustic transfer function. Through this, when a comparison value is greater than or equal to a predetermined value, it is determined that an intrusion has occurred. A gradual change in temperature and humidity of air within the surveillance space according to a temporal change, or a slow change in the acoustic transfer function occurring due to an environmental change may be accumulated. In this case, even though an intrusion has not occurred, the intrusion may be determined to have occurred. In order to solve the above malfunctioning issue, the present disclosure proposes a method of initializing a security setting at predetermined time intervals.

The present disclosure provides a method that measures an intrusion determining signal value (signal-to-noise ratio (SNR)) that is a ratio of an initial acoustic transfer function deviation (noise) to a variation value of a acoustic transfer function by setting a security setting to a predetermined time period, stores the measured intrusion determining signal value in an internal memory, and uses the stored intrusion determining signal value as data for analyzing a pattern. The present disclosure proposes a method that obtains information about a security setting initialization period through the pattern analysis, and finally optimizes a reference value (reference SNR) for determining a time period and whether an intrusion or an accident has occurred, thereby increasing the accuracy and reliability of security surveillance.

The present disclosure proposes a method that generates a sign sine wave sound source having different frequencies using a sound source generating apparatus, detects a pattern in which a acoustic transfer function varies based on magnitude of a frequency within a surveillance space to thereby identify a phenomenon occurring due to a change in the acoustic structure by an intrusion into the surveillance space, or a situation occurring due to a sudden change in temperature and humidity of indoor air and a convection such as activation of an air conditioning and heating device, thereby improving the accuracy of security surveillance.

The present disclosure proposes a method in which a sound source generating apparatus for generating sound, an acoustic receiving apparatus for detecting the sound, a signal processing unit, and a communication module are integrally provided to obtain a acoustic transfer function by processing a measured signal of the acoustic receiving apparatus, to determine whether an intrusion or an accident has occurred by comparing the acoustic transfer function with a predetermined security reference value, to store, in an internal memory, a security alert sound, an image obtained from an image obtaining apparatus installed within a surveillance space in an embedded form or an external interaction form, and acoustic information obtained from the embedded acoustic receiving apparatus and at the same time transmit the stored security alert sound, image, and acoustic information to a server or a mobile phone user when the intrusion or the accident is determined to have occurred.

The present disclosure proposes a method that collectively determines whether an intrusion or an accident has occurred by associating security information of a sound field variation detecting security system with a security camera, an IR sensor, an ultrasound sensor, and the like, and thereby increases the reliability of security surveillance.

Hereinafter, exemplary embodiments of the present disclosure will be described in detail with reference to the accompanying drawings. A configuration of the present disclosure and operation effect thereof will be clearly understood from the following detailed description. Prior to describing the present disclosure in detail, like reference numerals refer to like elements throughout the specification even though they are illustrated in the different drawings. When it is determined that the detailed description related to a related known function or configuration may make the purpose of the present disclosure unnecessarily ambiguous in describing the present disclosure, the detailed description will be omitted here.

FIG. 1 is a block diagram illustrating a structure of a security system based on sound field variation pattern analysis according to the present disclosure.

Referring to FIG. 1, the security system based on the sound field variation pattern analysis includes a sound field variation detecting apparatus 100, an operation apparatus 200, a corresponding institution 300, and a user terminal 400.

The sound field variation detecting apparatus 100 includes a sound source generator 110 to generate a sound, an acoustic receiver 120 to detect the sound, an image obtaining unit 160 to obtain an image, a controller 130 and a memory 140 to process and store a signal, a communication module 150 to transmit the stored information and security information to the operation apparatus 200, and the like. Here, the sound source generator 110, the acoustic receiver 120, and the image obtaining unit 160 are integrated in the sound field variation detecting apparatus 100.

In an audio frequency band (20 to 20 KHz), the sound source generator 110 outputs a single sine wave, a consecutive wave of a multi-tone sound source including a linear summation of sine waves having a plurality of frequencies, a pulse wave, pink noise, or white noise sound wave.

The acoustic receiver 120 receives the sound wave output from the sound source generator 110 and transfers the received sound wave to the controller 130.

The controller 130 determines whether an intrusion has occurred by comparing various sound field variation patterns, pre-stored in the memory 140, with a sound field variation pattern obtained in a security surveillance mode, and instructs the determination result to be transmitted to the operation apparatus 200.

The memory 140 stores examples of various sound field variation patterns, and stores data that is generated based on the security surveillance.

The communication module 150 transmits an alert and security information to the operation apparatus 200 through wireless fidelity (Wi-fi), Ethernet, ZigBee, Bluetooth, near field communication (NFC), a mobile communication network, and the like. Depending on embodiments, the communication module 150 may also be configured to directly transmit the alert and security information to the user terminal 400 without using the operation apparatus 200. In this case, information about the user terminal 400 needs to be pre-registered to the sound field variation detecting apparatus 100.

The user terminal 400 receives alert and security information over a communication network and provides the received alert and security information to a user. The user terminal 400 includes a personal communication service (PCS) phone, a personal digital assistant (PDA) phone, a global system for mobile communication (GSM) phone, a wideband code division multiple access (WCDMA) phone, a smart phone, and the like.

The information transmitted to the operation apparatus 200 may also be transmitted to the corresponding institution 300 such as a security office, a security company, a police station, and the like, and may also be directly transmitted to the pre-registered user terminal 400 over a mobile communication network.

Figure 2A:
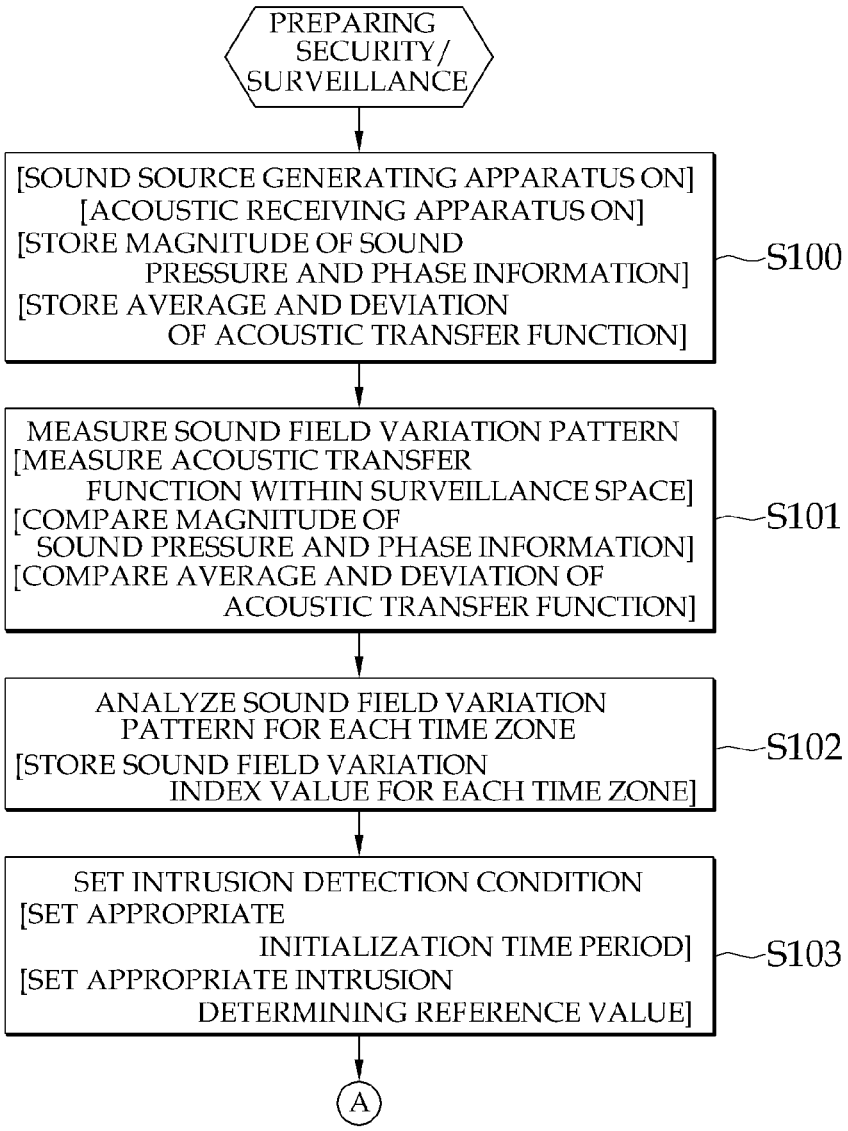
FIG. 2A to FIG. 2C are a flowchart to describe a method of measuring a sound field variation pattern and thereby monitoring a security according to an embodiment of the present disclosure.
Figure 2B:
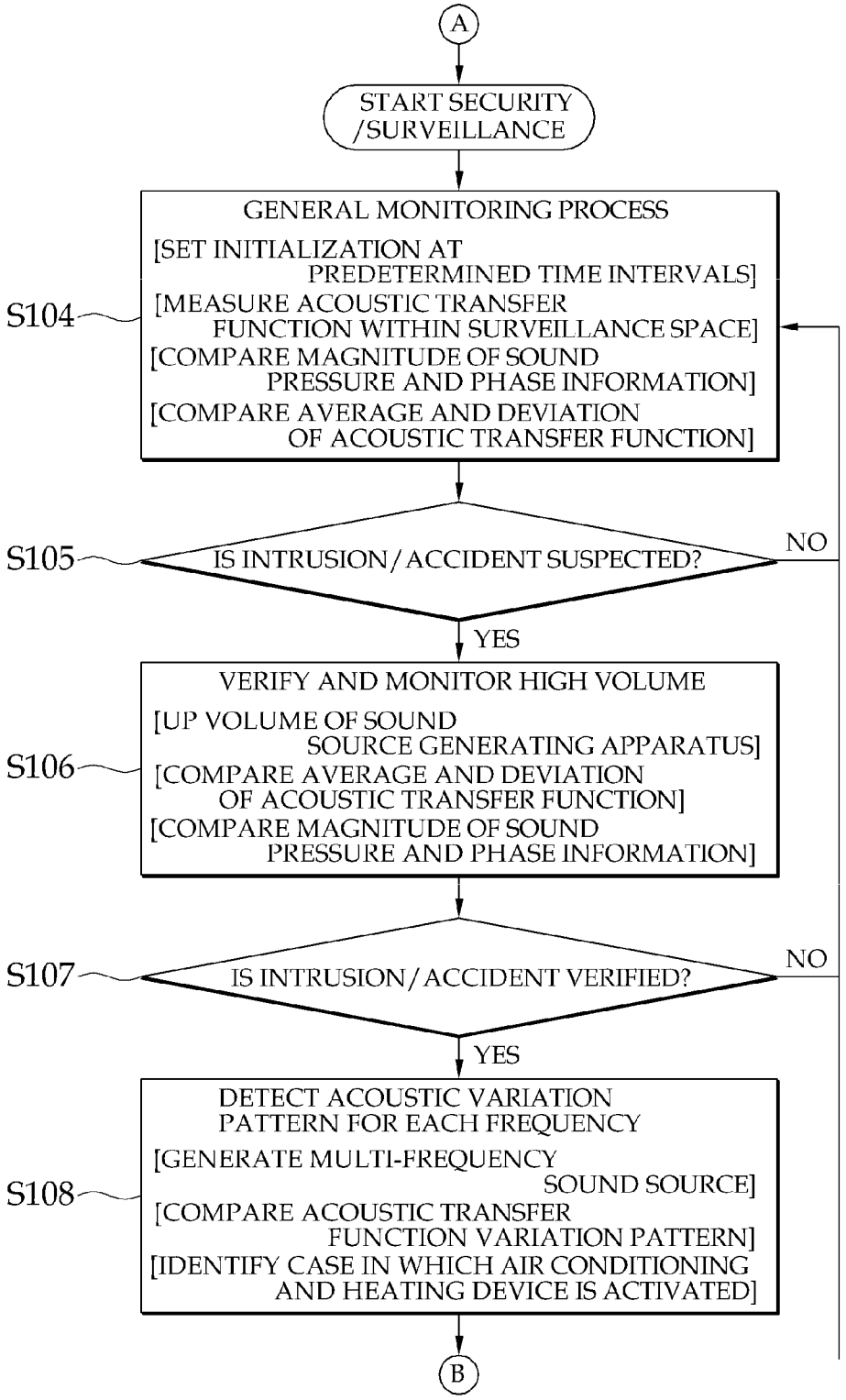
Figure 2C:
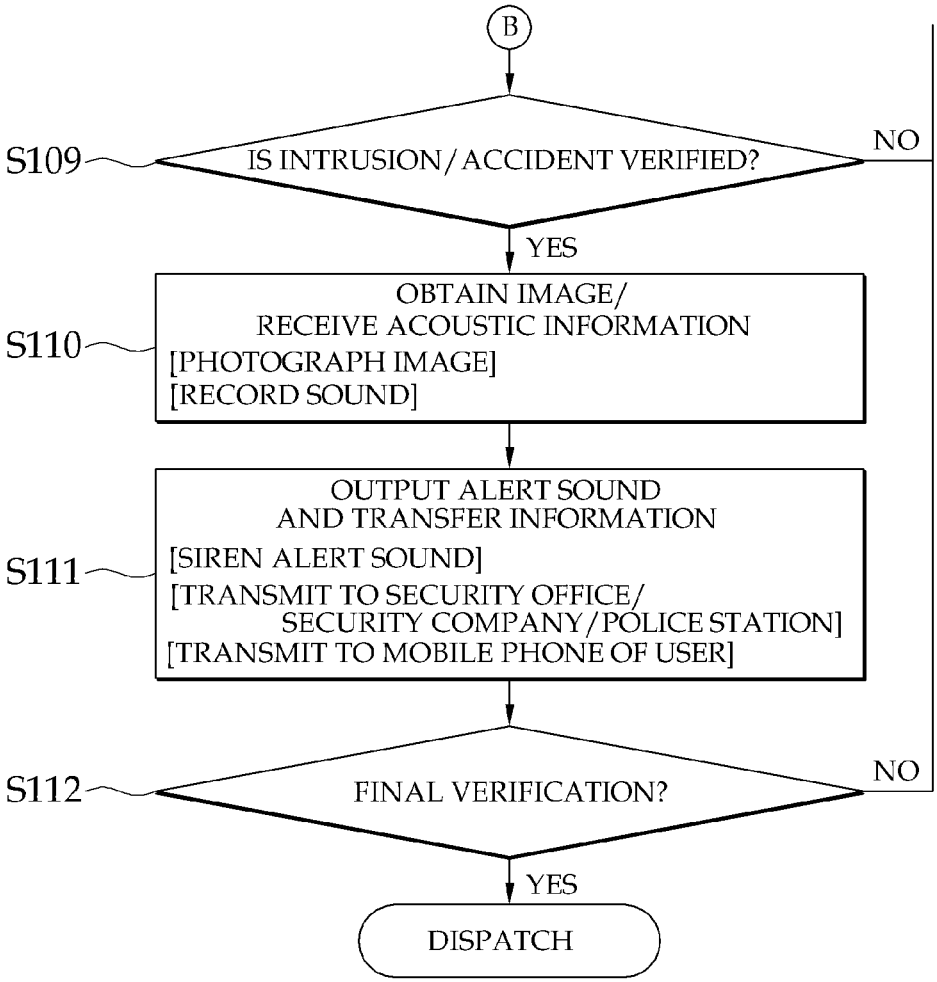

FIG. 2A to FIG. 2C are a flowchart to describe a method of measuring a sound field variation pattern and thereby monitoring a security according to the present disclosure. A security system includes an initial setting mode (S100 through S103), a sound field variation detecting mode (S104 through S109), and a final verification mode (S110 through S112). The sound field variation detecting mode includes a general monitoring process (S104 and S105), a process of verifying and monitoring a high volume (S106 and S107), and a process of detecting a sound field variation pattern for each frequency (S108 and S109).

When the security surveillance starts, the security system enters into an initial setting step (S100). In the initial setting step, the security system measures a acoustic transfer function within a surveillance space and stores the measured acoustic transfer function as reference acoustic transfer function information. The security system stores sound pressure magnitude and phase information, and stores the average and deviation of the acoustic transfer function.

When the initial setting is completed, the security system measures a sound field variation pattern (S101). For the above operation, the security system periodically measures a value of the acoustic transfer function at predetermined time intervals, measures a sound field variation using the measured value of the acoustic transfer function, and analyzes a sound field variation pattern for each time zone (S102).

The security system sets an initialization time period and a reference value to determine an intrusion/accident based on the analysis result (S103).

When the initial security mode setting is completed, the security system enters into the sound field variation detecting mode. Initially, the security system enters into a general monitoring process (S104). In the general monitoring process, the security system measures the acoustic transfer function at predetermined time intervals and calculates the average and deviation of the acoustic transfer function for each predetermined frequency. Here, the volume of the sound source generating apparatus is set to be a minimum level at which the intrusion/accident is detectable. By frequently resetting the initial value that is used to determine whether the intrusion/accident has occurred based on the time initialization period set in the above initial setting mode, a security alert sound does not ring by a slow change in the acoustic transfer function, such as a gradual change in temperature and humidity of air, and the like.

When the intrusion/accident occurs, or when a suspicious intrusion/accident occurs due to noise from an outside, and when the acoustic transfer function suddenly varies within a short period of time, the security system suspects that the intrusion/accident has occurred and thus, proceeds to a subsequent step (S105).

To prevent a malfunction by the external noise, the security system passes through a procedure of generating a high volume using the sound source generating apparatus to thereby verify whether the intrusion/accident has occurred (S106). Here, the security system may measure a sound pressure up to a maximum sound pressure mode by gradually increasing a level of the sound pressure that is generated from the sound source.

Meanwhile, due to a characteristic of the acoustic transfer function within the surveillance space, even though magnitude of the sound source increases, a ratio of an output signal to an input signal is consistent unless the intrusion occurs. Accordingly, the security system may determine whether the sound source has occurred due to slight external noise or an explicit intrusion/accident by comparing with the set initial value.

When the intrusion/accident is verified to have occurred in the high volume verifying and monitoring mode (S107), the security system detects a sound field variation pattern for each frequency (S108). The security system detects a sound field variation pattern according to a frequency change of a sound wave by employing sign sine waves having various frequencies as a sound source, and compares the detected sound field variation pattern with sound field variation patterns according to various reasons that are stored in the memory. Through this, the security system identifies whether the sound field variation has occurred due to a change in an internal acoustic structure such as opening and closing of a door and a window or movement of furniture by an intruder or intrusion, or due to a sudden change in temperature and humidity of indoor air and a convection such as activation of an air condition and heating device (S109).

When the intrusion or the accident is clearly determined to have occurred, the security system photographs and records an internal image and acoustic information within the surveillance space using the acoustic receiving apparatus, the image obtaining apparatus, and the like (S110).

Next, the security system transmits the photographed and recorded information to the operation apparatus 200 at the same time of outputting a siren alert sound. The operation apparatus 200 transmits the received information to the corresponding institution 300 such as a security office, a security company, a police station, and the like, and also directly transmits the received information to a pre-registered mobile phone of a user (S111). A person in charge of security and the user of the mobile phone analyze image and acoustic information, and take an appropriate action for dispatch when the intrusion/accident is finally verified to have occurred (S112).

Depending on embodiments, a partial process may be omitted from the above flowchart, or another process may be added and thereby be performed.

Figure 3A:
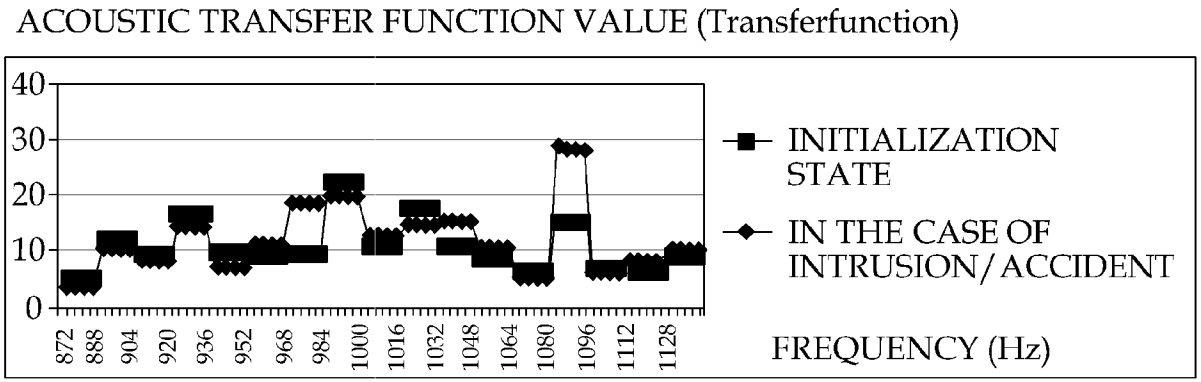
FIG. 3A is a graph illustrating comparison between an initial acoustic transfer function value before intrusion/accident and a acoustic transfer function value after intrusion/accident in a surveillance space for each frequency according to an exemplary embodiment of the present disclosure.

FIG. 3A is a graph illustrating comparison between a acoustic transfer function value of an initialization state within a surveillance space and a acoustic transfer function value within the surveillance space that has varied due to an intrusion. When expressing H(s) or H'(s) that is a acoustic transfer function used as a standard to monitor a situation of the surveillance space, the present disclosure follows a general scheme of obtaining a acoustic transfer function. Amp=20 log(H(s)) and Ph=ang(H(s)) are obtained with respect to an initial acoustic transfer function, and Amp'=20 log(H'(s)) and Ph'=ang(H'(s)) are obtained as the acoustic transfer function with respect to the varied surveillance space. Here, the acoustic transfer function H(s) is obtained as a value of Pout/Vin that is a ratio of sound pressure (Pout) of air, obtained through the acoustic receiving apparatus, to input voltage (Vin) of the sound source generating apparatus.

More specifically, FIG. 3A illustrates a graph comparing the acoustic transfer function value of the initialization state before intrusion/accident with the acoustic transfer function value after intrusion/accident, obtained for each frequency factor, by generating a multi-tone sound source including a linear summation of sign sine waves having a total of 17 frequencies in which a frequency span is 16 Hz based on a center frequency of 1 KHz and eight frequencies are present before and after the center frequency, by measuring, by the acoustic receiver, the acoustic transfer function within the surveillance space and Fourier transforming a signal.

In the case of a sound having a predetermined frequency, reinforcement by overlapping and offset interference occur due to a change in an internal structure of the surveillance space, which is different for each frequency. Accordingly, as shown in FIG. 3A, the difference significantly appears. Even in the same frequency, there is a deviation in which a sound pressure transfer function differs for each measurement. Therefore, even with respect to the same frequency, the change is consecutively indicated by performing consecutive measurement the predetermined number of times (here, five times).

Figure 3B:
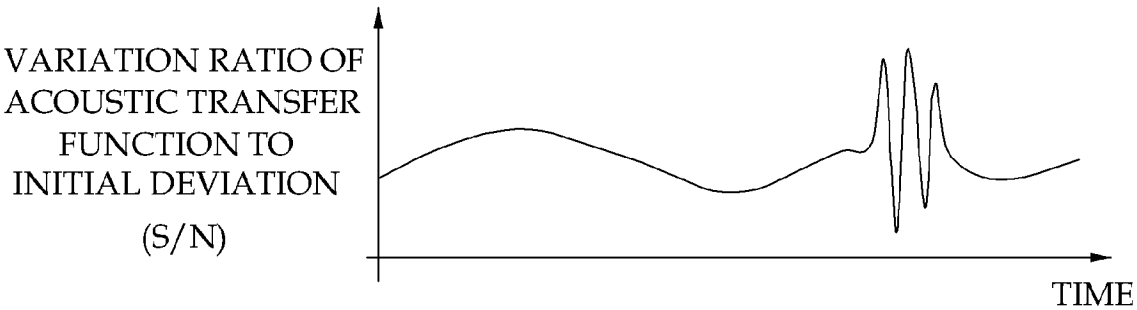
FIG. 3B is a graph illustrating a ratio of an intrusion signal value (signal) indicated as a acoustic transfer function, varying over time, to a reference noise value (noise) indicated as an initial deviation within a frequency distribution of the acoustic transfer function within a surveillance space according to an exemplary embodiment of the present disclosure.

FIG. 3B is a graph illustrating a ratio of an intrusion signal value (signal) indicated as a acoustic transfer function, varying over time, to a reference noise value (noise) indicated as an initial deviation within a frequency distribution of the acoustic transfer function within a surveillance space according to an exemplary embodiment of the present disclosure. Here, a maximum deviation value for each frequency is used as an initial deviation value, and indicated as noise for each frequency. The average value of the acoustic transfer function for each frequency is calculated and is compared with an initial value. Through this, an absolute value of a difference value (20 log(H')-20 log(H)) of the acoustic transfer function measured based on a predetermined time unit is used as a signal value and is indicated as "signal", and a value obtained by averaging a signal to noise ratio (signal/noise) in each frequency is indicated on a time axis.

In the case of actual application, a sound source of an audio frequency of 20 to 20 KHz may be variously used. A low frequency or a high frequency may be used, or a pulse sound source may be used to minimize noise by the generated sound.

As shown in FIG. 3B, the acoustic transfer function may slowly vary due to a gradual change in temperature and humidity of air or convection as well as a sudden change by an intrusion. In the present disclosure, in order to identify a variation of the acoustic transfer function occurring due to the environmental change from a sudden change occurring due to the intrusion/accident, a process of passing a preparing mode is required. In the preparing mode, a variation of a acoustic transfer function within the surveillance space is monitored in advance at predetermined time intervals, and a pattern of the variation is stored and analyzed.

In order to analyze the above variation pattern, and to exclude a variation of the acoustic transfer function by a slowly varying environmental change, it is important to obtain a time period value for initializing a acoustic transfer function value before intrusion/accident at predetermined time intervals. In order to optimally determine whether the intrusion/accident has occurred based on a predetermined time period, it is important to set an intrusion/accident determining reference value in a variation ratio of the acoustic transfer function to an initial deviation (S/N)

Figure 4:
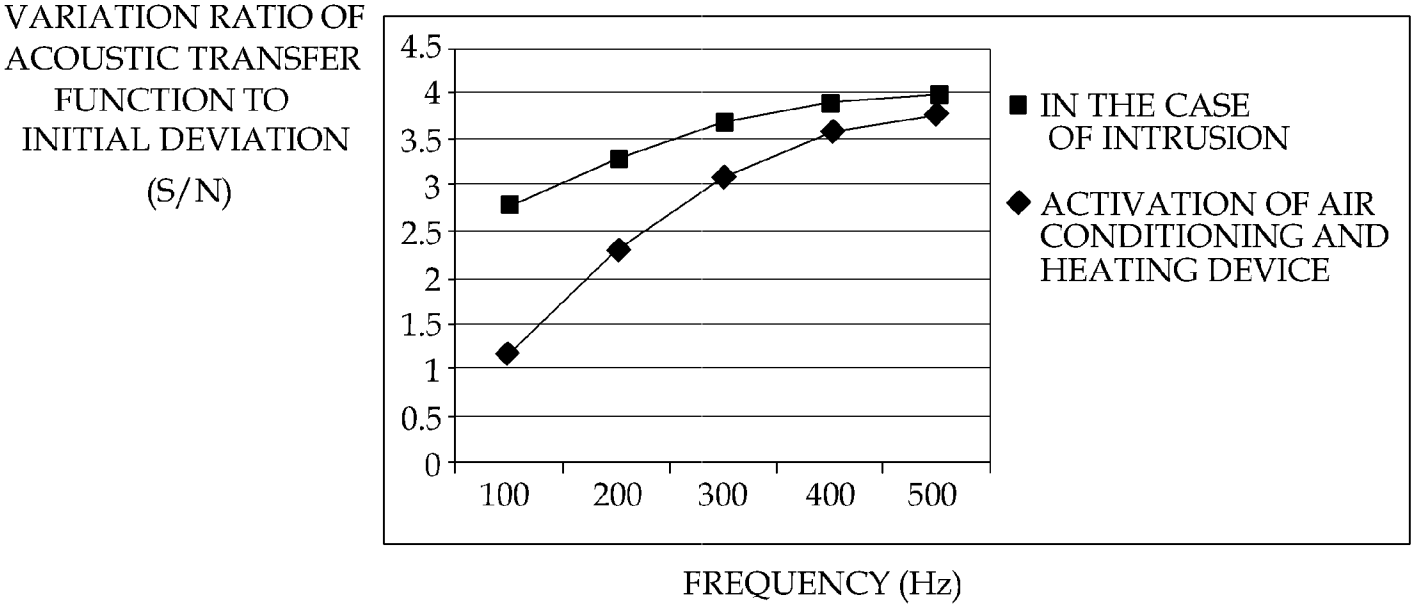
FIG. 4 is a graph illustrating an example of a sound field variation pattern occurring due to various reasons according to an exemplary embodiment of the present disclosure.

FIG. 4 is a graph illustrating an example of a sound field variation pattern occurring due to various reasons according to an exemplary embodiment of the present disclosure. Whether the sound field variation has occurred due to a change in an internal acoustic structure such as an intruder breaking into a surveillance space by intrusion or accident, opening or closing a door/window, furniture moved by the intruder, a change in an acoustic structure due to a disaster, and the like, or whether the sound field variation has occurred due to a sudden change in temperature and humidity of indoor air and convection by an air conditioner and an air cleaner, or a heater may be identified using sound sources of sign waves having various frequencies by detecting a sound field variation pattern according to a frequency change.

In the case of a sound field variation pattern within a predetermined surveillance space, a predicted pattern may be secured in advance through a theoretical simulation or an experiment. In general, a minute variation of a acoustic transfer function by the intruder may vary based on a frequency. Similarly, a change in temperature and humidity of indoor air may cause a change in sound velocity or air density and accordingly, change the acoustic transfer function. Even though a corresponding value varies based on a frequency of a sound wave, the sound field variation pattern may appear to be different from a sound field variation pattern by the intruder. When detecting the above sound field variation pattern and comparing sound field variation values of frequencies having a great sound field variation with respect to both cases, it is possible to identify the sound field variation by the intruder from the sound field variation by activation of the air conditioning and heating device.

Figure 5:
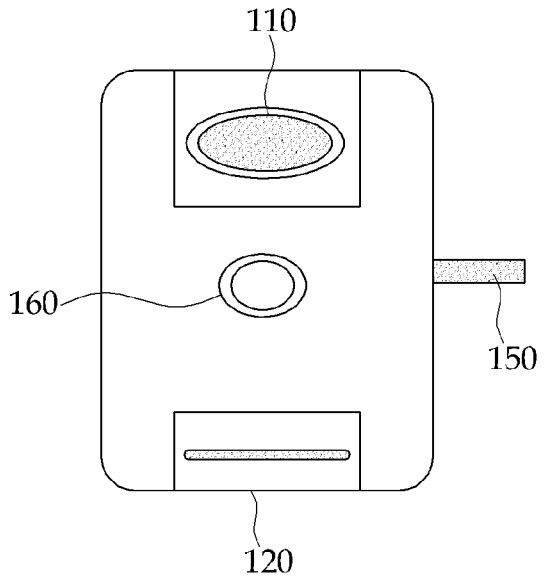
FIG. 5 is a diagram illustrating an example of a sound field variation detecting apparatus having the above function.

FIG. 5 is a diagram illustrating an example of a sound field variation detecting apparatus 100 having the above function. Referring to FIG. 5, the sound source generator 110, the acoustic receiver 120, and the image obtaining unit 160 are integrally configured on the front of the sound field variation detecting apparatus 100. In order to variously measure an acoustic transfer function within the surveillance space, the sound source generator 110 and the acoustic receiver 120 may be detached from a main body and then be placed at a predetermined position within the surveillance space while a line is being connected. The main body installed with the image obtaining unit 160 may be arbitrarily installed at a position at which a situation of the surveillance space may be most well monitored. A power source may be connected to a battery or a line, and stored image and acoustic information may be transferred to the operation apparatus 200 through the communication module 150.

Even though the image obtaining unit 160 is integrally configured in the exemplary embodiment of the present disclosure, the image obtaining unit 160 may be configured in an external type in interaction with an externally installed closed-circuit television (CCTV), an IP camera, and the like.

Figure 6:
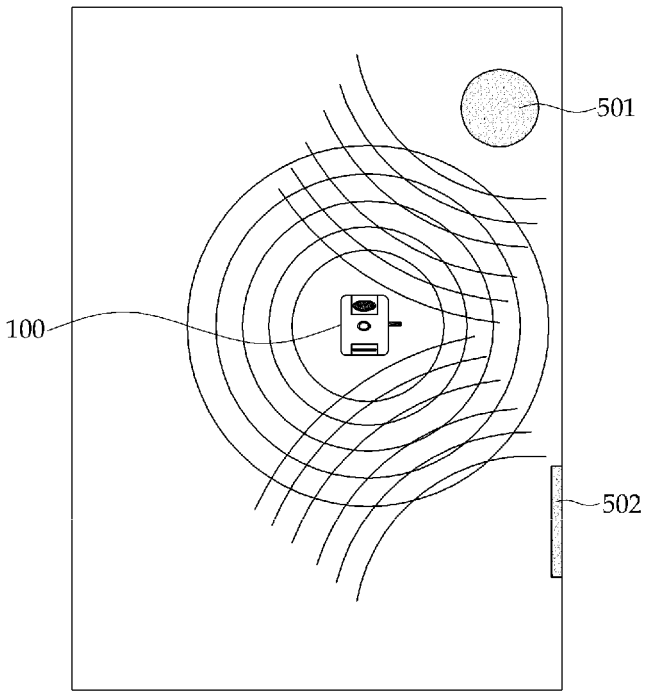
FIG. 6 is a diagram to describe a situation in which the sound field variation detecting apparatus of FIG. 5 is installed in a surveillance space to detect a sound field variation and to determine an intrusion.

FIG. 6 is a diagram to describe a situation in which the sound field variation detecting apparatus 100 of FIG. 5 is installed within a surveillance space to detect a sound field variation and to determine whether an intrusion has occurred. The sound field variation detecting apparatus 100 installed within the surveillance space detects the intrusion by detecting a sound field variation by an intruder 501, or a change in a door 502, a window, furniture, an internal structure, and the like by intrusion.

In the present disclosure, a scheme of measuring a sound field variation may detect the sound field variation as a acoustic transfer function variation within the surveillance space regardless of a position of an intruder, a position of a window and the like, or a position of an accident within the surveillance space. Therefore, it is possible to solve or complement weaknesses found in an existing security system such as a security camera, an IR sensor, an ultrasound sensor, an acoustic detector, and the like. Compared to an existing sound field variation detecting security system, whether the intrusion has occurred is determined by detecting a sound field variation pattern according to a temporal change of the sound field variation and a frequency change of a sound source. Accordingly, it is possible to solve a malfunctioning issue occurring due to an environmental change such as a change in temperature and humidity and the like.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A security system based on sound field variation pattern analysis, comprising:

a sound field variation detecting apparatus installed within a predetermined surveillance space that receives a sound wave that has been generated by a sound source, and that obtains a sound field variation pattern by comparing an initial acoustic transfer function to a measured acoustic transfer function, and that detects an abnormal situation by reading the sound field variation pattern; and an operation apparatus that receives the sound field variation pattern and that notifies an external apparatus about an emergency situation when the abnormal situation is detected, wherein the sound field variation pattern is obtained by measuring an intrusion determining signal value (signal-to-noise ratio (SNR)) that is a ratio of an initial sound transfer function deviation to a variation value of an acoustic transfer function for a predetermined time period, wherein the sound field variation detecting apparatus periodically resets the initial acoustic transfer function.

2. The system of claim 1, further comprising:

an image obtaining apparatus that obtains image information of the surveillance space and that provides the obtained image information to the operation apparatus when the sound field variation detecting apparatus detects the abnormal situation.

3. The system of claim 1, wherein the sound field variation detecting apparatus comprises:

a sound source generator that outputs a sound wave of an audio frequency band having a predetermined frequency band within the predetermined surveillance space;

a sound wave receiver that receives the sound wave output from the sound source generator;

a controller that analyzes the sound field variation pattern for each frequency band using the received sound wave, and that provides an analysis result of the sound field variation pattern;

memory that stores the sound field variation pattern; and a communication module that transfers the analysis result of the sound field variation pattern to the external apparatus.

4. The system of claim 1, wherein the sound field variation detecting apparatus sends the sound field variation pattern to the operation apparatus when the sound field variation detecting apparatus detects the abnormal situation, and the operation apparatus notifies a pre-stored user terminal device and a corresponding institution about the emergency situation.

5. A security method based on sound field variation pattern analysis, comprising:

outputting a sound wave of an audio frequency band having a predetermined frequency band into a surveillance space;

receiving the sound wave;

calculating a measured acoustic transfer function from the received sound wave;

comparing an initial acoustic transfer function with the measured acoustic transfer function to create a sound field variation pattern, and to determine whether an abnormal situation has occurred;

analyzing the sound field variation pattern to determine whether an intrusion has occurred, when the abnormal situation is determined to have occurred;

transferring the sound field variation pattern to an operation apparatus when the intrusion is determined to have occurred, and notifying a pre-registered external apparatus about whether the intrusion has occurred; and periodically resetting the initial acoustic transfer function.

6. The method of claim 5, wherein the sound field variation pattern is analyzed by comparing the sound field variation pattern with a pre-stored sound field variation pattern of an exceptional situation.

7. The method of claim 6, wherein the exceptional situation includes a sudden change in temperature and humidity of indoor air or convection.

8. The method of claim 6, wherein the sound wave is a consecutive wave of a multi-tone sound source including a linear summation of sine waves having a plurality of frequencies.

9. The method of claim 5, wherein the pre-registered external apparatus is notified about whether the intrusion has occurred by instructing, by a sound field variation detecting apparatus, an interacting image obtaining apparatus to obtain an image within the surveillance space when the intrusion is determined to have occurred, and transferring, by the image obtaining apparatus, the obtained image to the operation apparatus together with the sound field variation pattern.

10. The method of claim 5, wherein the external apparatus includes a user terminal device and a corresponding institution, and the corresponding institution is an institution that copes with the emergency situation.

11. The method of claim 5, wherein the initial acoustic transfer function is reset by measuring an acoustic transfer function within the surveillance space in an initial security mode.

* * * * *